US011137132B2

(12) United States Patent
Garner

(10) Patent No.: US 11,137,132 B2
(45) Date of Patent: Oct. 5, 2021

(54) LOW-PROFILE TRACK SYSTEMS AND DEVICES

(71) Applicant: JUNIPER DESIGN GROUP INC., Brooklyn, NY (US)

(72) Inventor: Michael Garner, North Barrington, IL (US)

(73) Assignee: JUNIPER DESIGN GROUP INC., Brooklyn, NY (US)

( * ) Notice: Subject to any disclaimer, the term of this patent is extended or adjusted under 35 U.S.C. 154(b) by 0 days.

(21) Appl. No.: 16/829,730

(22) Filed: Mar. 25, 2020

(65) Prior Publication Data

US 2020/0232631 A1 Jul. 23, 2020

Related U.S. Application Data

(63) Continuation of application No. 16/253,687, filed on Jan. 22, 2019, now Pat. No. 10,627,086.

(51) Int. Cl.

| | |
|---|---|
| ***F21V 21/35*** | (2006.01) |
| ***F21V 21/088*** | (2006.01) |
| ***F21V 23/00*** | (2015.01) |
| ***F21V 21/30*** | (2006.01) |

(52) U.S. Cl.

CPC ..... *F21V 21/35* (2013.01); *F21V 21/088* (2013.01); *F21V 21/30* (2013.01); *F21V 23/001* (2013.01)

(58) Field of Classification Search

CPC ..... F21V 21/35; F21V 21/088; F21V 23/001; F21V 21/30; F21V 21/096; F21V 17/14; F21Y 2115/10; F21W 2131/107

See application file for complete search history.

(56) References Cited

U.S. PATENT DOCUMENTS

| | | | | | |
|---|---|---|---|---|---|
| 3,345,471 | A * | 10/1967 | Kilburg | H02G 5/04 | 191/45 R |
| 3,832,503 | A | 8/1974 | Crane | | |
| 4,919,625 | A | 4/1990 | Coutre | | |
| 5,341,276 | A * | 8/1994 | Shen | H01R 25/142 | 248/343 |
| 5,833,358 | A * | 11/1998 | Patik | F21V 21/0808 | 362/391 |
| 6,059,582 | A | 5/2000 | Tsai | | |
| 6,079,992 | A * | 6/2000 | Kuchar | F21V 17/14 | 362/287 |
| 6,190,198 | B1 | 2/2001 | Ray | | |

(Continued)

*Primary Examiner* — Truc T Nguyen

(74) *Attorney, Agent, or Firm* — Adam P. Daniels, Esq.; Polsinelli LLP

(57) ABSTRACT

A track lighting device includes a clamp assembly having a dual engagement mechanism for coupling to a track. For example, the clamp assembly includes a collar rotatable about a collar axis, and a cam follower having a cam-pin received by a first groove of a cam. The cam also includes a second groove and a first engagement member. The first groove translates a rotational movement of the collar and the cam follower into a linear movement along the collar axis to releasably couple the first engagement member to the track. The clamp assembly also includes a latch assembly having a second engagement member and a latch-pin in communication with the second groove of the cam. At least a portion of the latch assembly pivots about a latch axis based on movement of the latch-pin relative to the second groove to couple the second engagement member to the track.

20 Claims, 8 Drawing Sheets

(56) References Cited

U.S. PATENT DOCUMENTS

| | | | | |
|---|---|---|---|---|
| 6,204,632 | B1 * | 3/2001 | Nierescher | H02J 7/0013 320/116 |
| 6,497,586 | B1 * | 12/2002 | Wilson | H01R 13/73 362/383 |
| 7,520,762 | B2 * | 4/2009 | Lehman | F21V 21/35 439/115 |
| 7,654,834 | B1 * | 2/2010 | Mier-Langner | H01R 25/14 439/115 |
| 7,914,198 | B2 | 3/2011 | Mier-Langner et al. | |
| 2002/0064979 | A1 | 5/2002 | Zakerzewski | |
| 2002/0137374 | A1 | 9/2002 | O'Rourke et al. | |
| 2003/0223234 | A1 | 12/2003 | Tang | |
| 2004/0005798 | A1 * | 1/2004 | Lin | H01R 25/14 439/110 |
| 2005/0078482 | A1 | 4/2005 | Bartlett | |
| 2008/0081500 | A1 * | 4/2008 | Chen | H01R 25/145 439/209 |
| 2010/0055947 | A1 | 3/2010 | Fong | |
| 2010/0311267 | A1 | 12/2010 | Mouchon et al. | |
| 2011/0141749 | A1 | 6/2011 | Fishman et al. | |
| 2011/0312199 | A1 * | 12/2011 | Alrutz | H01R 13/639 439/188 |
| 2014/0016503 | A1 | 1/2014 | Altekar et al. | |
| 2015/0024615 | A1 | 1/2015 | Lindblom et al. | |
| 2016/0104985 | A1 | 4/2016 | Ewing et al. | |
| 2019/0353335 | A1 | 11/2019 | Terumichi | |

* cited by examiner

LOW-PROFILE TRACK SYSTEMS AND DEVICES

CROSS REFERENCE TO RELATED APPLICATIONS

This application is a continuation of U.S. patent application Ser. No. 16/253,687, filed on Jan. 22, 2019 and entitled "Low-Profile Track Lighting Systems and Devices." The contents of which are incorporated herein by reference.

TECHNICAL FIELD

The present disclosure generally relates to track systems, and more particularly to low profile track systems and devices.

BACKGROUND

Conventional light fixtures generally provide a fixed housing with an electrical socket for receiving a light emitting element such as a light bulb. In operation, such conventional light fixtures are "plugged" into corresponding electrical sockets with appropriate wiring, terminal plugs, and so on. However, the position of the electrical socket within the fixed housing and/or the length of wiring between the fixed housing and an electrical socket often limit the light fixture placement in a given space or room.

Track lighting systems provide flexible fixture placement options for a given environment by using an electrified track that is mountable on a variety of surfaces (e.g., ceilings, walls, beams, rafters, etc.). In operation, a track fixture couples to various locations along the length of an electrified track. In this fashion, track systems offer adjustable light placement options along an electrified track. However, in order to comply with various industry standards (e.g., mechanical strength tests, load tests, force tests, etc.), many existing track lighting systems include bulky fixtures and/or high profile electrified tracks in order to provide adequate surface area for securing a corresponding track-light fixture. In addition, such track lighting systems may be difficult to install, often requiring two hands to provide appropriate force and/or torque to secure track-light fixtures to corresponding electrified tracks.

BRIEF DESCRIPTION OF THE DRAWINGS

The embodiments herein may be better understood by referring to the following description in conjunction with the accompanying drawings in which like reference numerals indicate identical or functionally similar elements. Understanding that these drawings depict only exemplary embodiments of the disclosure and are not therefore to be considered to be limiting of its scope, the principles herein are described and explained with additional specificity and detail through the use of the accompanying drawings in which.

DESCRIPTION OF EXAMPLE EMBODIMENTS

Overview

Figure 1:
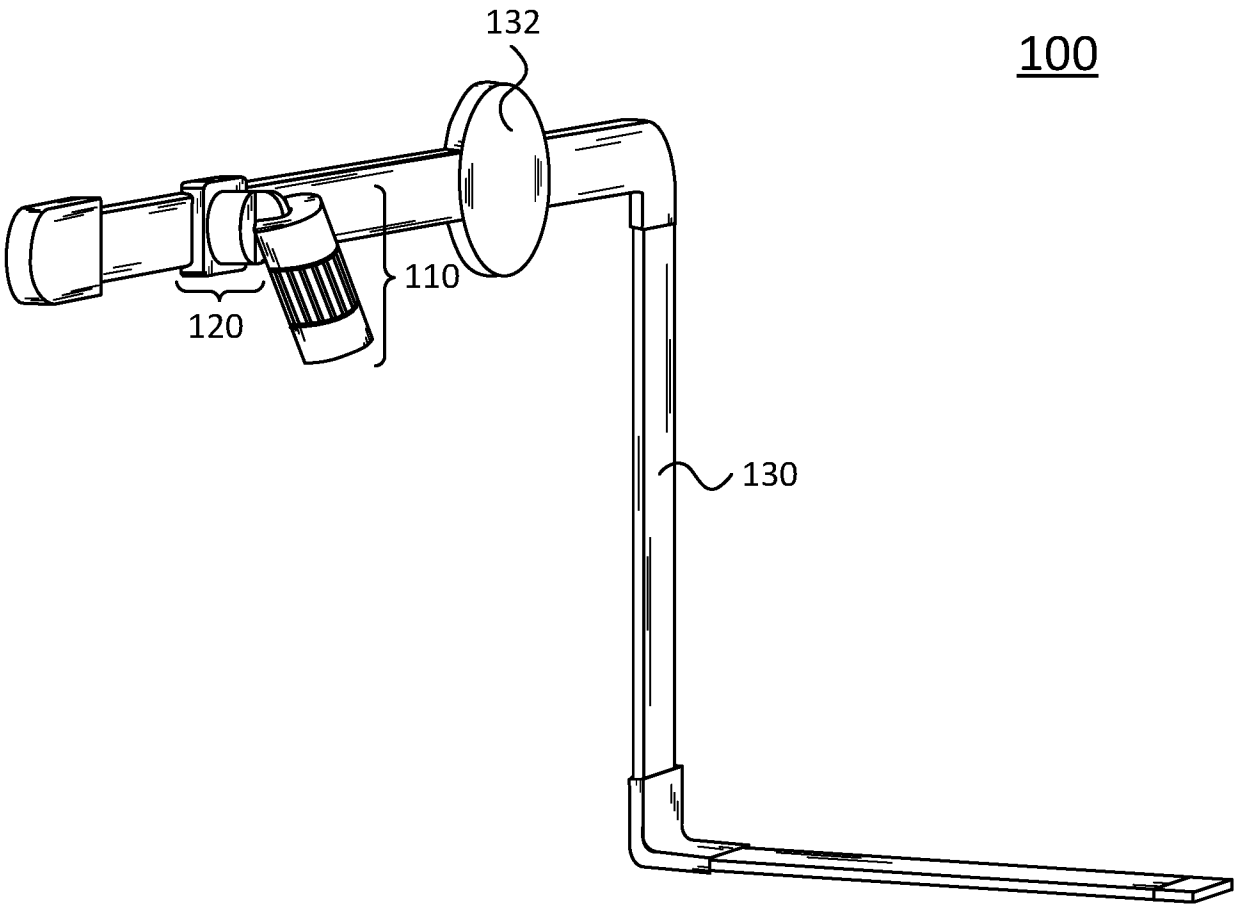
FIG. 1 illustrates an isometric view of a track lighting system, according to one embodiment of this disclosure.

According to one or more embodiments of the disclosure, a track lighting device includes a low-profile form with dual engagement mechanisms for securing the track lighting device to a corresponding track. For example, in one embodiment, the track lighting device includes a lighting component having at least one light emitting element and a clamp assembly for releasably coupling the lighting component to a track. The clamp assembly includes a collar rotatable about a collar axis, a cam follower disposed within the collar and rotatable about the collar axis, and a cam having a first groove that receives a cam-pin from the cam follower. The first groove translates rotational movement of the cam follower about the collar axis to a linear movement along the collar axis to couple a first engagement member to the track (e.g., a top side of the track). The clamp assembly also includes a latch assembly having a second engagement member and a latch-pin in communication with a second groove of the cam. In operation, a portion of the latch assembly pivots about a latch axis based on movement of the latch-pin relative to the second groove to releasably couple the second engagement member to the track (e.g., a side channel of the track).

Description

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Unless otherwise apparent, or stated, terms of direction, orientation, and/or relative position (e.g., "front," "rear," "left," "right," "top," "bottom," "upper," "lower," "outward," "inward," and the like) are used for explanation and convenience to refer to certain features of this disclosure. However, these terms are not absolute, and should not be construed as limiting this disclosure.

In addition, as used herein, the terms "coupled", "secured," and/or "engaged" refers to components being mechanically, electrically, magnetically, and/or electromagnetically connected to each another either directly or indirectly or through one or more intermediary components.

As mentioned above, existing track fixtures comply with industry standards that set forth the types and amount of forces the fixture must withstand. These standards influence track fixture designs, which often results in large and bulky lighting fixtures since larger components can provide greater surface areas for dispersing, attenuating, or otherwise resisting forces. However, bulky lighting fixtures are aesthetically displeasing and may be difficult to secure or attach to a corresponding track. Accordingly, this disclosure describes a new low-profile track fixture system that meets or exceeds various industry standards by leveraging dual engagement mechanisms that releasably couple a track light fixture to a corresponding track.

Referring now to the figures, FIG. 1 illustrates an isometric view of a track lighting system 100, according to one embodiment of this disclosure. As shown, track lighting system 100 generally has a low form profile and includes a lighting assembly 110, a clamp assembly 120, and a track 130. Lighting assembly 110 couples to clamp assembly 120, and clamp assembly 120 operably secures lighting assembly 110 to track 130 using two or dual engagement mechanisms, discussed in detail herein.

Track 130 includes electrical components and wiring that provide power to lighting assembly 110. Track 130 can include a number of interlocking track segments that can be positioned at various respective angles and along any given surface. A junction box 132 electrically couples track 130 (e.g., electrical components, wiring, etc.) to existing electrical wires in a room or space.

Figure 2:
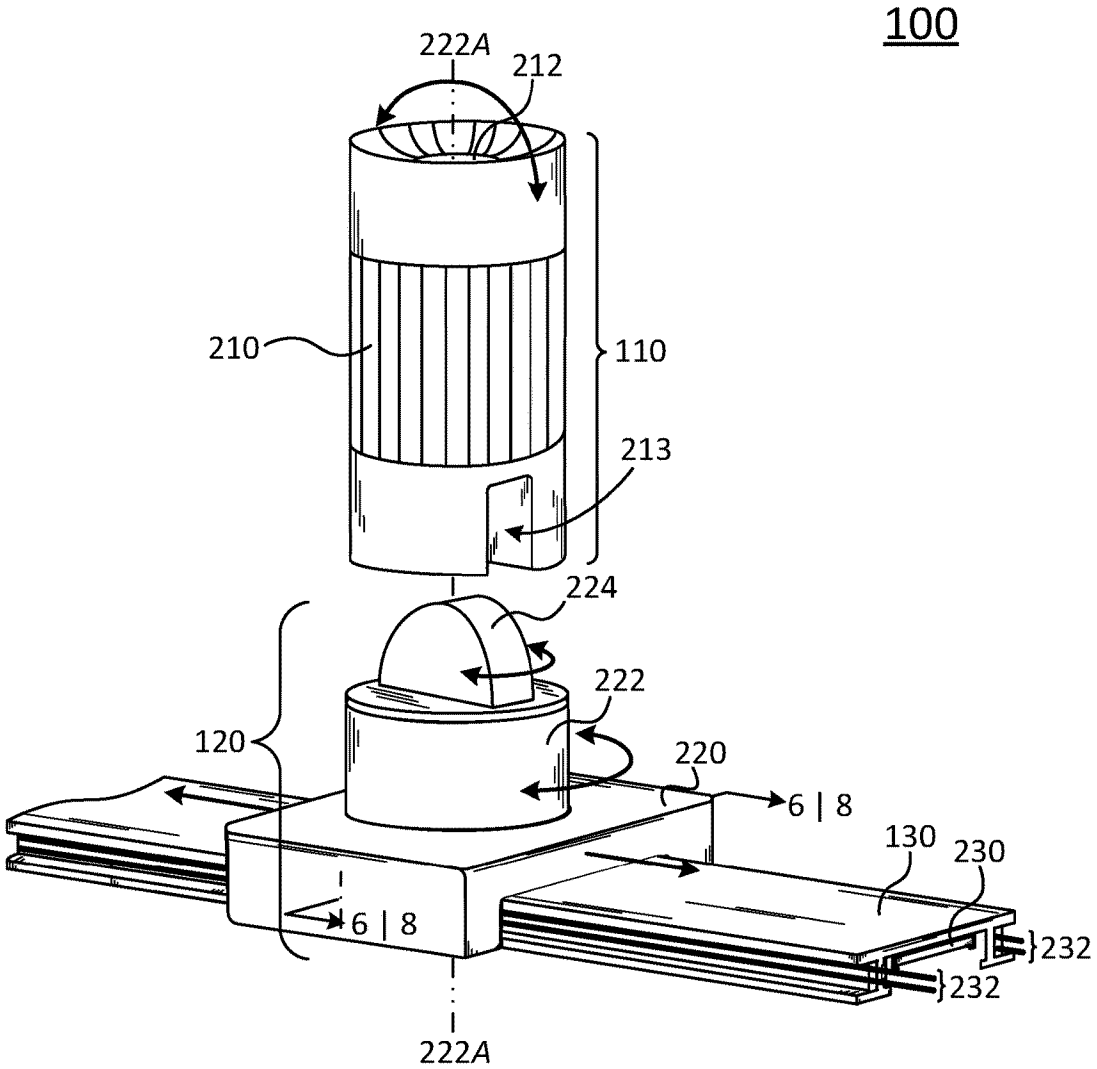
FIG. 2 illustrates a partial exploded isometric view of the track lighting system shown in FIG. 1, showing a track, a lighting assembly, and a clamp assembly for releasably attaching the lighting assembly to the track.

FIG. 2 illustrates a partial exploded isometric view of track lighting system 100, showing lighting assembly 110 separated or detached from clamp assembly 120.

Here, lighting assembly 110 includes a light emitting element 212 (e.g., a light emitting diode (LED), an incandescent bulb, a halogen bulb, a compact fluorescent bulb, and so on) disposed in a generally circular housing 210. Housing 210 forms a slot 213, which is dimensioned to receive a correspondingly sized portion of an attachment member 224 of clamp assembly 120.

Clamp assembly 120 includes a generally rectangular base 220, a circular collar 222, and an attachment member 224 for coupling lighting assembly 110 to clamp assembly 120. Base 220 includes a rectangular top portion with downwardly depending side flanges that define a channel for receiving portions of track 130. Base 220 generally acts as a track guide that facilitates positioning clamp assembly 120 relative to track 130 with portions of track 130 positioned and/or disposed within the channel. For example, when base 220 is releasably secured to track 130, the rectangular top portion generally sits flush or proximate to a corresponding top surface of track 130, and the side flanges engage with corresponding side flanges of track 130.

Track 130 generally includes an elongated rectangular body, side flanges that form channels that receive electrical wires 232, and one or more brackets (which may form a channel) to secure a sub-track plate 230 along a bottom surface of track 130, opposite the top surface. In this fashion, track 130 defines a first track engagement plane substantially parallel to its top/bottom surfaces and one or more second engagement planes parallel the sides of track 130—e.g., parallel to terminating ends of the side flanges forming the channels for receiving electrical wires 232. In this fashion, the second engagement planes are oriented substantially perpendicular to the first track engagement plane.

Track 130 operably provides electrical power to components of clamp assembly 120, which transfer the electrical power to light assembly 110. Notably, sub-track plate 230 can include a magnetic or ferromagnetic material that magnetically (or electromagnetically) couples with one or more magnetic components (e.g., engagement member(s)) of clamp assembly 120), as discussed herein. In alternative embodiments, it is also appreciated that sub-track plate 230 can include magnetic components, while clamp assembly 120 may include the ferromagnetic material.

When assembled, slot 213 receives a protruding portion of attachment member 224 to couple light assembly 110 to clamp assembly 120. Clamp assembly 120 couples to track 130, mechanically and electrically (and/or electromagnetically), using two engagement mechanisms, as discussed in detail below. For example, clamp assembly 120 can include a first engagement member that releasably engages with track 130 along the first engagement plane and a second engagement member that releasably engages with track 130 along the second engagement plane.

Light assembly 110 can be dynamically adjusted to position light assembly at various positions along track 130 and/or at various angles relative to track 130. For example, clamp assembly 120 can be releasably secured to various locations along track 130, as indicated by the direction arrow shown as generally parallel to track 130. In operation, clamp assembly releasably engages with track 130 by a rotational movement of collar 222 about a collar axis 222A, as indicated by rotational arrow. The rotational movement causes one or more engagement members of clamp assembly 120 to releasably engage with to track 130.

In some embodiments, the rotational movement causes a first engagement mechanism to releasably couple to a top of track 130 and a second engagement mechanism to releasably couple to side portions of track 130. In addition, attachment member 224 provides a fulcrum that allows lighting assembly 110 to pivot about collar axis 222A, thereby adjusting its angle relative to track 130. Moreover, attachment member 224 can also rotate about collar axis 222A, which rotates lighting assembly 110 about the same.

Figure 3:
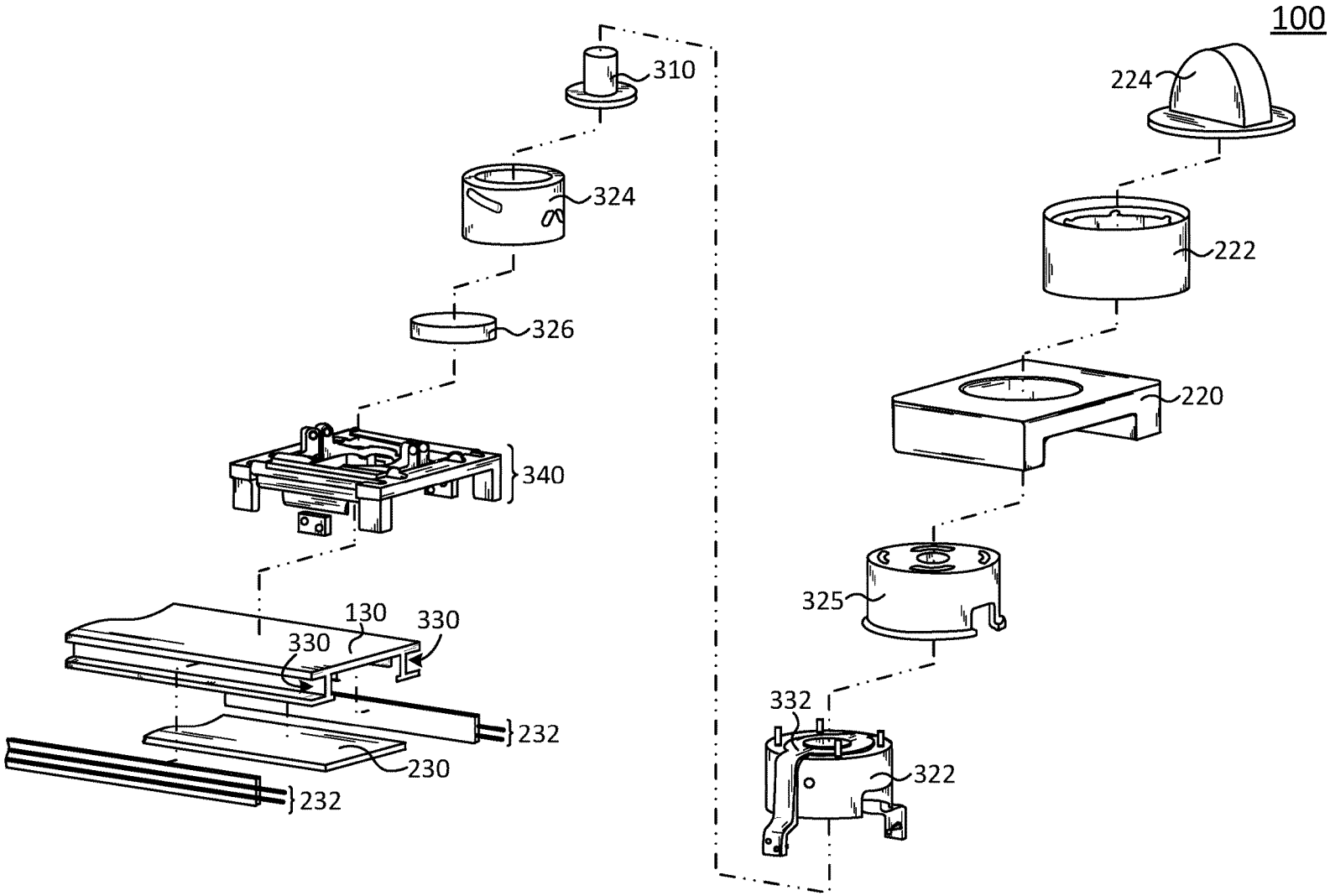
FIG. 3 illustrates an exploded isometric view of the clamp assembly shown in FIG. 2.

FIG. 3 illustrates an exploded isometric view of clamp assembly 120. In particular, clamp assembly 120 includes attachment member 224, collar 222, base 220, an inner collar 325, a lighting assembly fastener 310, a cam follower 322, an electrical connector 332, a cam 324, a first engagement member 326, and a latch assembly 340. First engagement member 326 of clamp assembly 120 and second engagement members of latch assembly 340 cooperate to form dual engagement mechanisms for releasably attaching clamp assembly 120 to track 130.

As shown, attachment member 224 includes an outwardly extending radial bottom flange that sits within a corresponding mating interior circumferential recessed lip on collar 222. The circumferential lip on collar 222 includes slots for registering one or more posts that operably communicate or transfer rotational movement of collar 222 to cam follower 322.

Collar 222, base 220, inner collar 325, electrical connector 332, and cam follower 322 each include corresponding circular apertures. In particular, the apertures of collar 222, inner collar 325, electrical connector 332, and cam follower 322 are dimensioned to receive a protruding portion of lighting assembly fastener 310. The aperture of base 220 is dimensioned to receive a portion of inner collar 325 (which, when assembled, extends there-through). The generally circular body of collar 222 defines a hollow interior and has an outer diameter larger than the aperture of base 220 such that collar 222 sits on a top surface of base 220.

Inner collar 325 has a cylindrical body with a hollow interior. As mentioned above, inner collar 325 includes a circular aperture for receiving the protruding portion of lighting assembly fastener 310. In addition to this circular aperture, inner collar 325 also includes other apertures for receiving the posts associated with cam follower 322. These apertures allow the posts to move about the periphery of the circular aperture based on the rotational movement of collar 222.

In addition, the cylindrical body of inner collar 325 defines an outwardly extending peripheral bottom skirt that engages with the interior portion of base 220 or a bottom surface of base 220, opposite the top surface. The hollow interior receives electrical connector 332, which sits on top a generally cylindrical cam follower 322.

Electrical connector 332 includes a circular plate defining an aperture, discussed above. The circular plate is dimensioned to fit inside of inner collar 325 (e.g., proximate with a top interior surface of the inner collar). In addition, the circular plate includes a pair of downwardly depending plate arms having electrical contacts, fasteners, or the like, for electrically coupling with electrical wires 232 of the track. Electrical connector 332 operably transfers electrical power from track 130 (e.g., electrical wires 232) to corresponding components of lighting assembly 110 (e.g., light emitting element 212).

Notably, the electrical contacts may be offset relative to each other to engage a particular pair of electrical wires 232. For example, in some embodiments, pairs of electrical wires 232 may be associated with different switches, outlets, control signals (e.g., Power Line Communication (PLC) signals, Pulse Width Modulation (PWM) signals, etc.), and so on. In this fashion, the offset positions of the electrical contacts allows the clamp assembly to engage with a first pair of electrical wires when oriented (and releasably attached) to the track in a first direction, and engage with a second pair of electrical wires when the clamp assembly is oriented (and releasably attached) to the track in a second direction (e.g., 180 degree rotations).

Lighting assembly fastener 310 includes a generally cylindrical body, forming the protruding portion, and an outwardly extending bottom flange. Lighting assembly fastener 310 operably urges or secures electrical connector 332, inner collar 325, collar 222, and attachment member 224 together, with base 220 disposed between.

Figure 6:
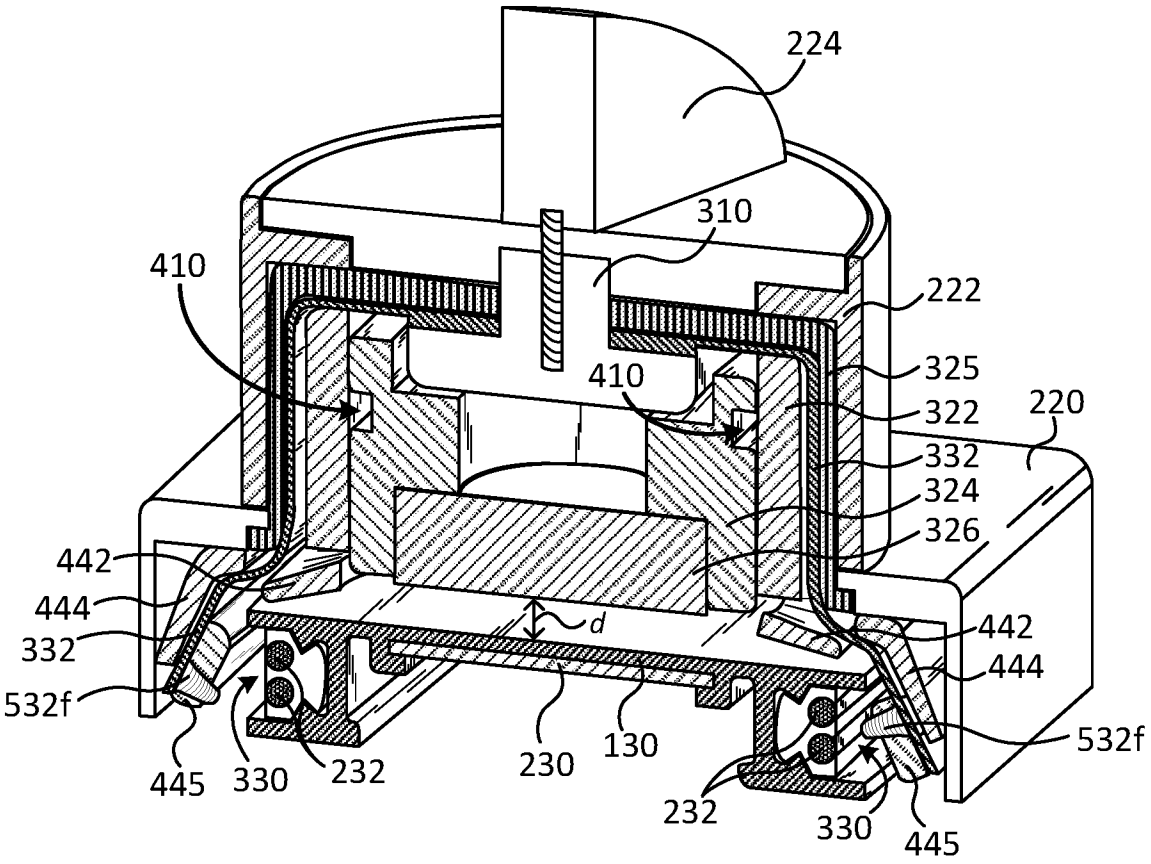
FIG. 6 illustrates a cross-sectional view of the track lighting system shown in FIG. 2, viewed at cut-lines 6-6 and showing the track lighting system releasably detached from the track.
Figure 8:
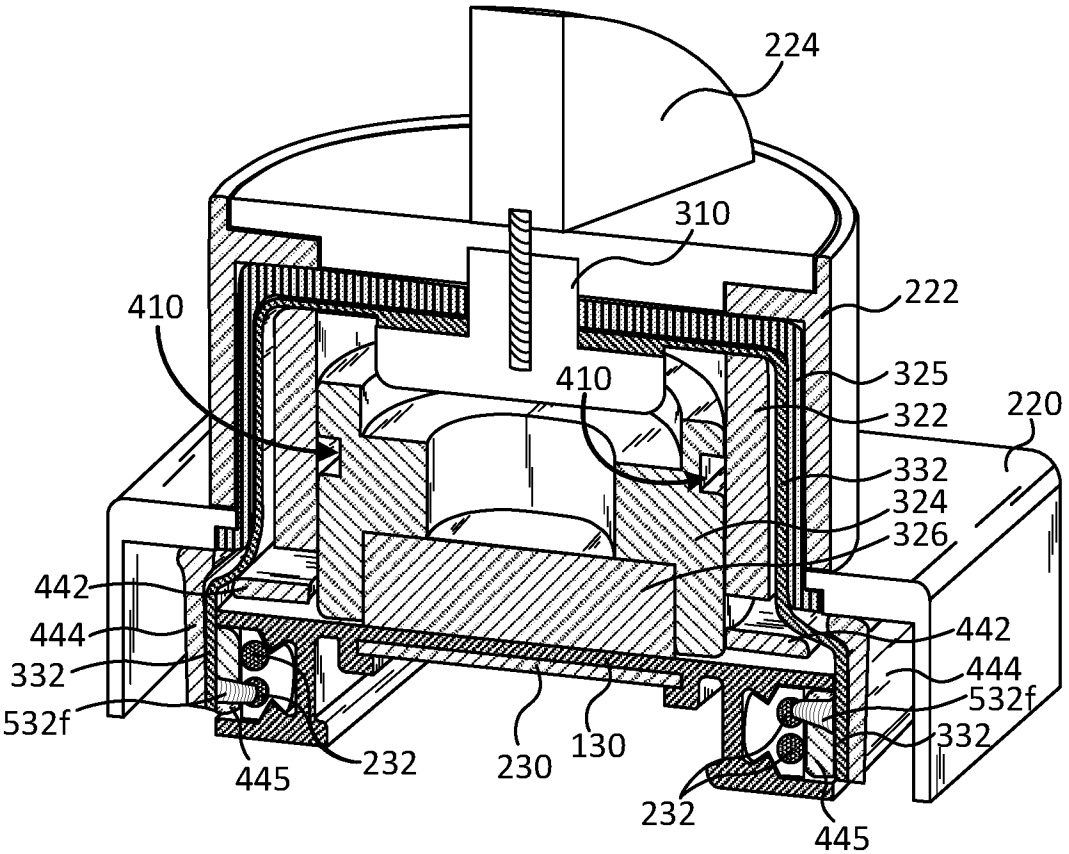
FIG. 8 illustrates a cross-sectional view of the track lighting system shown in FIG. 2, viewed at cut-lines 8-8 and showing the track lighting system releasably attached to the track.

For example, when assembled, the protruding portion of light assembly fastener 310 extends through the respective apertures of the circular plate of electrical connector 332, inner collar 325, base 220, and collar 222, and engages with or couples to attachment member 224. In operation, securing the protruding portion of light assembly fastener 310 to attachment member 224 urges or pulls the outwardly extending radial bottom flange of attachment member 224 into contact with portions of the recessed lip of collar 222 positioned on a top side of base 220—e.g., the radial bottom flange of attachment member 224 sits on the recessed lip of collar 222. At the same time, the outwardly extending bottom flange of light assembly fastener 310 engages with a bottom surface of the circular plate of electrical connector 332. In turn, a top surface (opposite the bottom surface) of the circular plate engages with a top interior surface of inner collar 325 and urges inner collar 325 toward attachment member 224, which also causes the peripheral bottom skit of inner collar 325 to engage with an interior portion of base 220—e.g., the interior surface of base 220 proximate the perimeter of its aperture. Cut sectional views of a complete assembly are shown in FIGS. 6 and 8 (discussed in greater detail below).

Still referring to FIG. 3, cam follower 322 includes a cam-pin that communicates with a corresponding groove on a cam 324 (e.g., a "first groove"). Cam follower 322 includes a generally cylindrical body having a hollow interior that receives cam 324. Similarly, cam 324 includes a generally cylindrical body having a cavity that receives a first engagement member 326. In some embodiments, cam 324 and first engagement member 326 may be integrally formed.

While the releasably securing/attaching operations between clamp assembly 120 and track 130 are discussed in greater detail with reference to FIGS. 4-8, however in brief, collar 222 rotates about the collar axis (e.g., collar axis 222A, FIG. 1), which causes cam follower 322 to rotate about the same. It is also appreciated that cam follower 322 rotates about a cam axis (not shown), however, the cam axis is coincident with collar axis 222A and for purposes of discussion herein, the cam axis is assumed to be coincident with collar axis 222A.

Rotational movement of cam follower 322 causes the cam-pin to slide within the helical groove on cam 324, thereby translating the rotational movement of cam follower 322 (e.g., about the collar axis) to linear movement for cam 324 (e.g., along the collar axis). This linear movement also moves the first engagement member 326 toward or away from track 130. Notably, first engagement member 326 may mechanically engage with track 130 and/or, in some embodiments, first engagement member 326 can include a magnet that can magnetically or electromagnetically couple to sub-track plate 230.

Cam 324 also includes one or more second grooves that communicate with components of latch assembly 340 (e.g., latch-pins). The linear movement of cam 324 along the collar axis also moves the corresponding second grooves along the collar axis, which can portions of the latch assembly 340 to pivot. As discussed in detail below, the pivot motion of latch assembly 340 further moves one or more second engagement members into communication with respective channels 330 of track 130 (e.g., "track-channels"). In this fashion, the linear movement of cam 324 can also cause the second engagement member(s) to releasably secure the clamp assembly to track 130.

Track 130 generally includes an elongated rectangular body having side flanges that form channels 330. Channels 330 receive electrical wires 232, which may include pairs of electrical wires for respective sides. In addition, track 130 also includes one or more brackets that forms a channel for receiving and securing sub-track plate 230 along its bottom surface, opposite the top surface.

Figure 4:
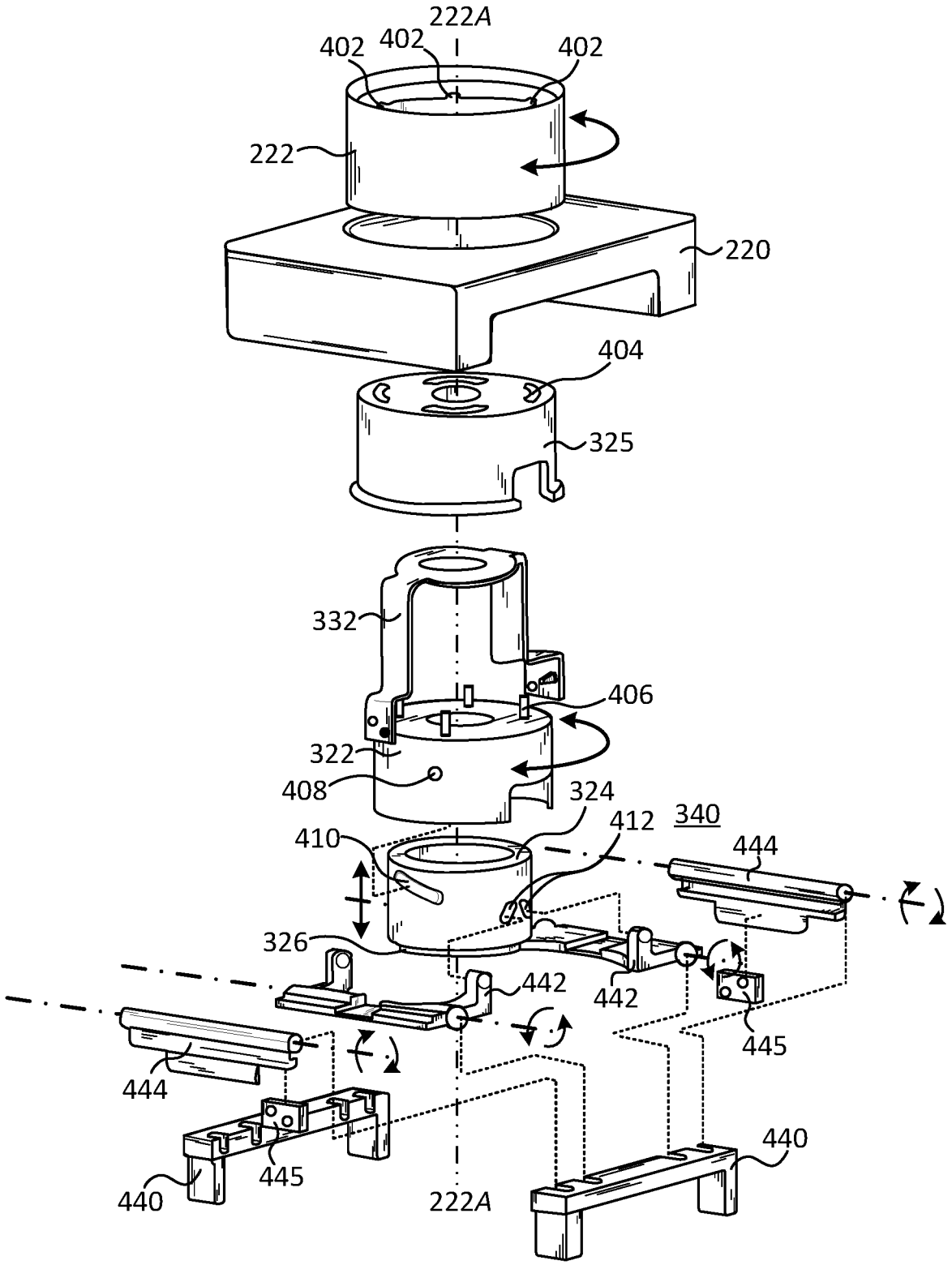
FIG. 4 illustrates an exploded isometric view of the clamp assembly shown in FIG. 2, particularly showing components of a latch assembly.

FIG. 4 illustrates an exploded isometric view of clamp assembly 120, and more particularly, shows positions of clamp assembly component relative to collar axis 222A, as well as components that form latch assembly 340.

As mentioned above, many of the illustrated components include cylindrical bodies that have hollowed interiors for receiving other components. For example, collar 222 receives portions of inner collar 325, which receives portions of electrical connector 332 and cam follower 322, which receives cam 324, which receives first engagement member 326.

In operation, collar 222 rotates about collar axis 222A to releasably secure the clamp assembly to the track. Collar 222 communicates or operably transfers its rotational movement about collar axis 222A to cam follower 322 by one or more posts 406, which operably communicates or registers with corresponding slots or notches 402 on the circumferential lip on collar 222.

Posts 406 couple to, or are otherwise associated with, cam follower 322. When assembled, posts 406 extend through corresponding apertures 404 on inner collar 325. Apertures 404 are dimensioned to allow posts to circumferentially rotate about collar axis 222A.

In addition, cam follower 322 also includes a cam-pin 408, which operably communicates with a helical groove 410 of cam 324. When cam follower 322 rotates about collar axis 222A, cam-pin 408 moves or slides within helical groove 410 of cam 324. In turn, the movement of cam-pin 408 in helical groove 410 translates the rotational movement of cam follower 322 about collar axis 222A into linear movement of cam 324 along collar axis 222A. The linear movement of cam 324 moves first engagement member 326 toward the track to releasably engage first engagement member 326 with the track (e.g., a top surface of the track).

As mentioned above, the track can define multiple engagement planes, where a first engagement plane can be substantially parallel to top/bottom surfaces of the track and a second engagement can be oriented perpendicular to the first engagement plane and substantially parallel to a the sides of the track (e.g., parallel to terminating ends of the side flanges of track 130). When cam 324 moves first engagement member 326 toward the track, it can cause the first engagement member to releasably engage with the track along the first engagement plane.

In addition, the linear movement of cam 324 also moves one or more second grooves 412 along collar axis 222A. The movement of second grooves 412 operably moves components of latch assembly 340 to releasably engage with portions of the track (e.g., along one or more second engagement planes).

For example, latch assembly 340 generally includes one or more second engagement members that releasably attaches the clamp assembly to side channels (e.g., channels 330) of the track (e.g., track 130) based on movement of second grooves 412 of cam 324. Notably, although the components of latch assembly 340 include pairs of mirror image components, the discussion herein may refer to the components in a singular form. However, it is appreciated that these pairs of mirror image components include the same structure and perform the same functionality.

As shown, latch assembly 340 includes latch bases 440, levers 442, latch-arms 444, and latch plates 445. Latch bases 440, includes downwardly projecting side flanges that sit flush or proximate to corresponding side surfaces of track 130 (not shown here) to help clamp or secure latch assembly 340 to track 130. In addition, latch bases 440 include corresponding sets of hinge-slots for receiving levers 442 and latch-arms 444. When assembled, levers 442 and latch-arms 444 are disposed in respective hinge-slots, and pivot about respective axes (indicated by rotational arrows), which releasably couples latch assembly 340 to the track.

In detail, each lever 442 includes a lever body having an annular interior that surrounds a portion of the cylindrical body of cam 324, and a notch that receives laterally extending portions of the downwardly depending plate arms of electrical connector 332. The lever body also includes outwardly projecting latch-hinge members received by corresponding hinge-slots of latch bases 440. On one side, the lever body forms a shoulder and on an opposing side, the lever body forms a pair of upwardly projecting members that include latch-pins. The latch-pins are disposed in, and operably communicate with, one of the respective second grooves 412 of cam 324.

Each latch-arm 444 includes an arm body having outwardly projecting arm-hinge members received by corresponding hinge-slots of latch bases 440. The arm body forms a channel for receiving the shoulders of respective levers 442 and downwardly depends from respective levers toward the track. The arm body operably guides latch plates 445 toward or away from the side channels of the track.

Latch plates 445 include holes that receive electrical contacts associated with electrical connector 332. In particular, when assembled, the downwardly depending plate arms of electrical connector 332 extend through the notches of corresponding levers 442 toward the track. The electrical contacts couple to portions of the plate arms of the electrical connector 332 and extend through the holes of corresponding latch plates 445, thereby securing the latch plates to respective plate arms. Latch plates 445 may be further sized and dimensioned to mechanically couple to side portions of the track (e.g., portions of the flanges that form channels 330 of track 130), thereby releasably securing the latch assembly (and thus, the clamp assembly) to the track.

Collectively, the second engagement member(s) can refer to one or more components of latch assembly 340, such as latch bases 440, levers 442, latch-arms 444, and latch plates 445. In operation, cam 324 (and second grooves 412) moves along collar axis 222A, which causes levers 442 to pivot in respective hinge-slots of latch base 440. The pivoting movement of levers 442 causes the shoulder of respective lever bodies to engage or disengage with the channels of corresponding latch-arms 444. In turn, the latch-arms 444 move corresponding latch plates toward or away from the side portions of the track.

Figure 5A:
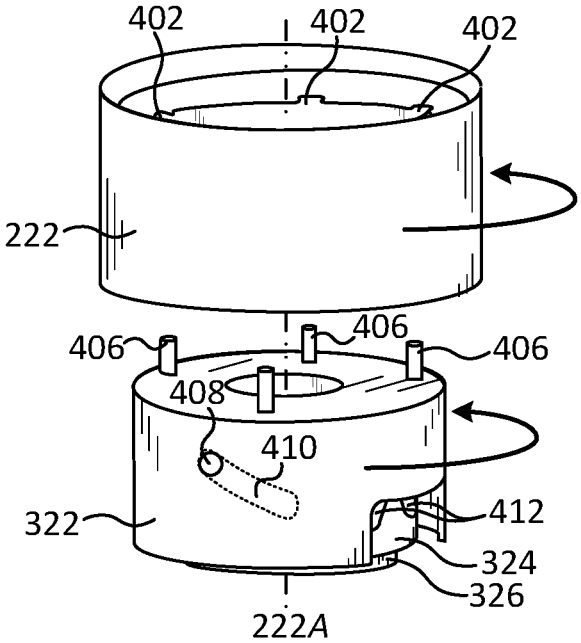
FIG. 5A illustrates a partial exploded isometric view of the track lighting system shown in FIG. 4, showing clockwise rotational movement of a collar and a cam follower about a collar axis and a corresponding linear movement of a cam along the collar axis.
Figure 5B:
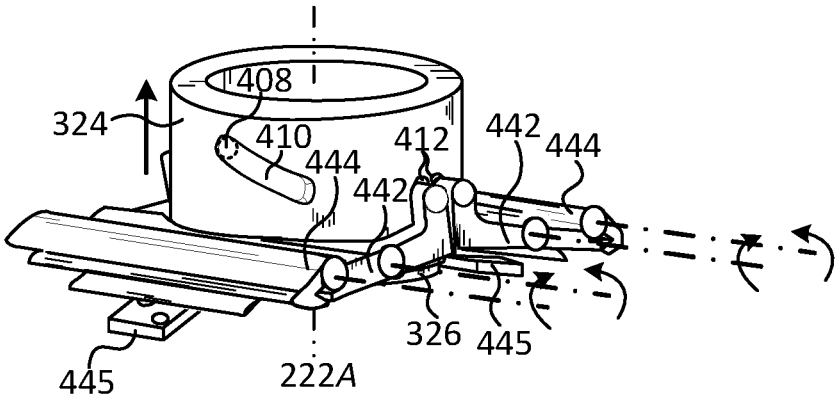
FIG. 5B illustrates an alternative isometric view of the track lighting components shown in FIG. 5A, showing the linear movement of the cam and pivotal movements of the latch assembly.
Figure 5C:
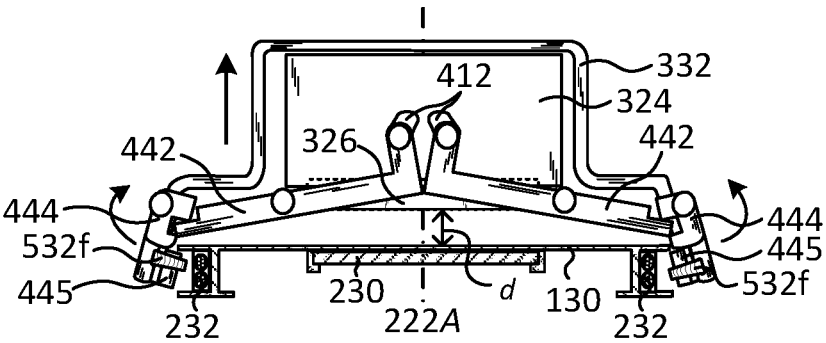
FIG. 5C illustrates an alternative side-elevation view of the track lighting system shown in FIG. 5B, showing the clamp assembly and the latch assembly releasably detached from the track.

FIGS. 5A-5C illustrate operations for releasably disengaging or decoupling the dual engagement mechanisms of the clamp assembly relative to the track. For example, FIG. 5A generally represents operations to releasably disengage a first engagement mechanism (e.g., first engagement member 326) relative to the track. FIG. 5B generally represents operations to releasably disengage a second engagement member (e.g., components of latch assembly 340) relative to the track. FIG. 5C generally represents cooperative operations of the first engagement mechanism and the second engagement mechanism to releasably disengage the clamp assembly relative to the track.

In detail, FIG. 5A illustrates a partial exploded isometric view of portions of clamp assembly 120, showing clockwise rotational movement of collar 222 and cam follower 322 about collar axis 222A, and a corresponding linear movement of cam 324 along collar axis 222A.

As mentioned above, cam follower 322 includes posts 406 that register with notches 402 of collar 222. When collar 222 rotates about collar axis 222A, the posts 406 communicate or transfer the rotation of collar 222 to cam follower 322. In addition, the rotational movement causes cam-pin 408 to move within helical groove 410 of cam 324. Here, cam-pin 408 moves toward a top or upper portion of helical groove 410, which effectively translates the rotational movement of cam follower 322 into a linear movement of cam 324 along collar axis 222A. More particularly, the clockwise rotational movement of cam follower 322 about collar axis 222A results in a linear movement of cam 324 upward or away from the track, which releasably disengages or decouples first engagement member 326 from the top surface of the track.

In some embodiments, first engagement member 326 can include a magnetic component that magnetically or electromagnetically engages or disengages with a corresponding ferromagnetic material of the track based on a distance there-between. As is appreciated by those skilled in the art, the magnetic attraction between the magnetic component of first engagement member 326 and the ferromagnetic material of the track reduces according to the inverse square law of their relative distances. Here, the linear movement of cam 324 moves first engagement member 326 away from the track by a distance that reduces the magnetic attraction, thus disengaging or decoupling first engagement member 326 from the track.

FIG. 5B illustrates an alternative isometric view of the track lighting components shown in FIG. 5A, showing linear movement of cam 324 and pivotal movements of the latch assembly. In particular, FIG. 5B illustrates cam 324 movement in a linear direction along collar axis 222A away from the track, as indicated by the directional arrow.

The linear movement of cam 324 also moves second grooves 412 in the same direction, which transfers the linear movement to latch-pins of levers 442 disposed in second grooves 412, causing levers 442 to pivot about respective latch-axes. This pivotal movement causes the shoulders of respective levers 442 to disengage with the respective channels of corresponding latch-arms 444, further causing the latch-arms 444 to pivot about respective arm-axes. In turn, the latch-arms 444 move respective latch plates 445 away from corresponding sides of the track, thus disengaging or decoupling the latch assembly from the track.

FIG. 5C illustrates an alternative side-elevation view of the track lighting system shown in FIG. 5B, showing the clamp assembly and the latch assembly releasably detached from the track. In particular, the cam movement in the linear direction along collar axis 222A (away from the track) moves first engagement member 326 away from the track by a distance d. For example, first engagement member 326 may physically disengage from a top surface of track 130 and/or first engagement member 326 may magnetically or electromagnetically decouple from sub-track plate 230. As discussed, this movement mechanically, magnetically, or electromagnetically decouples the clamp assembly from track 130. In addition, electrical contacts, such as the illustrated fasteners 532*f*, electrically disengage from corresponding electrical wires 232 disposed in side channels of track 130.

FIG. 6 illustrates a cross-sectional view of the track lighting system shown in FIG. 2, viewed at cut-lines 6-6. Here, track lighting system 100 is releasably detached or decoupled from track 130.

As shown, first engagement member 326 and latch plate 445 (e.g., a second engagement member) releasably disengage from track 130. For example, first engagement member 326 disengages from track 130—e.g., first engagement member 326 moves away from a top surface of track 130 to disengage any physical interfacing, and/or first engagement member 326 moves away from sub-track plate 230 (e.g., by a distance d) to prevent magnetic/electromagnetic coupling. Similarly, components of the latch assembly disengage from track 130—e.g., latch plate 445 moves away from the side flanges that form channels 330 of track 130 to disengage any physical interfacing, and/or latch plate 445 moves the electrical contacts of electrical connector 332 away from contact with electrical wires 232.

Figure 7A:
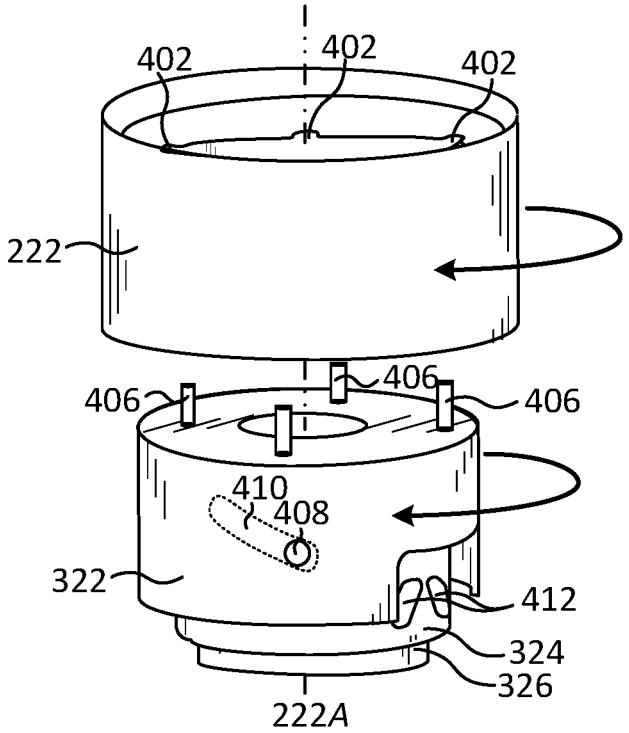
FIG. 7A illustrates a partial exploded isometric view of the track lighting system shown in FIG. 4, showing counterclockwise rotational movement of the collar and the cam follower about the collar axis and the corresponding linear movement of the cam along the collar axis.
Figure 7B:
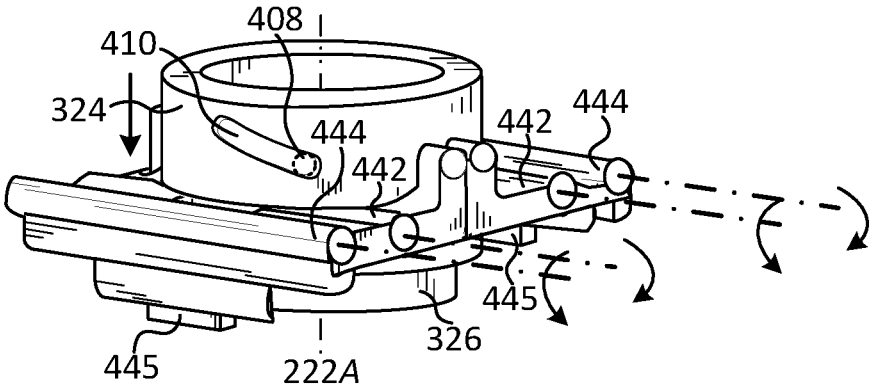
FIG. 7B illustrates an alternative isometric view of the track lighting components shown in FIG. 7A, showing the linear movement of the cam and pivotal movements of the latch assembly.
Figure 7C:
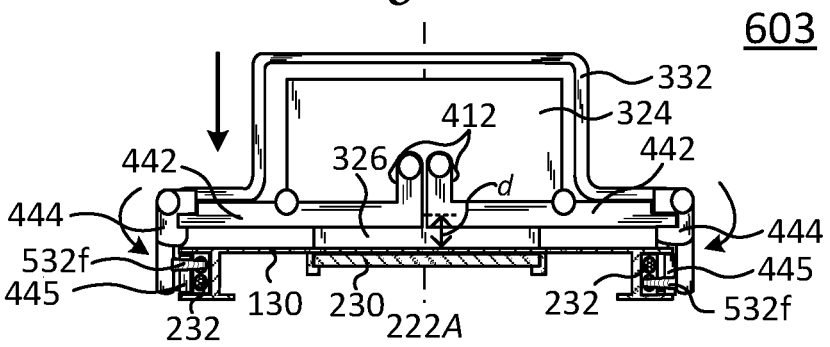
FIG. 7C illustrates an alternative side-elevation view of the track lighting system shown in FIG. 7B, showing the clamp assembly and the latch assembly releasably attached to the track.

FIGS. 7A-7C illustrate operations for releasably engaging or coupling the dual engagement mechanisms of the clamp assembly relative to the track. For example, FIG. 7A generally represents operations to releasably engage a first engagement mechanism (e.g., first engagement member 326) relative to the track. FIG. 7B generally represents operations to releasably engage a second engagement member (e.g., components of latch assembly 340) relative to the track. FIG. 7C generally represents cooperative operations of the first engagement mechanism and the second engagement mechanism to releasably engage the clamp assembly relative to the track.

In detail, FIG. 7A illustrates a partial exploded isometric view of portions of clamp assembly 120, showing counter-clockwise rotational movement of collar 222 and cam follower 322 about collar axis 222A, and a corresponding linear movement of cam 324 along collar axis 222A.

As discussed, posts 406 register with notches 402 of collar 222 and transfer the rotational movement of collar 222 about collar axis 222A to cam 324, thus causing cam 324 to rotate about the same. The rotational movement of cam 324 moves cam-pin 408 within helical groove 410 of cam 324. For example, the counter-clockwise movement of cam-pin 408 in helical groove 410 moves cam-pin toward a bottom or lower portion of helical groove 410, which effectively translates the rotational movement of cam follower 322 about collar axis 222A into linear movement of cam 324 along collar axis 222A. More particularly, the counter-clockwise rotational movement of cam follower 322 about collar axis 222A results in a linear movement of cam 324 downward or toward the track, which releasably engages or couples first engagement member 326 with the top surface of the track.

In some embodiments, first engagement member 326 can include a magnetic component that magnetically/electromagnetically engages with a corresponding ferromagnetic material of the track based on a distance there-between. Here, the linear movement of cam 324 moves first engagement member 326 toward from the track, reducing the distance between first engagement member 326 and the ferromagnetic material of the track, thus increasing the magnetic attraction there-between to releasably engage or couple first engagement member 326 to the track.

FIG. 7B illustrates an alternative isometric view of the track lighting components shown in FIG. 7A, showing linear movement of cam 324 and pivotal movements of the latch assembly. In particular, FIG. 7B illustrates cam 324 movement in a linear direction along collar axis 222A toward the track, as indicated by the directional arrow. The linear movement of cam 324 also moves second grooves 412 in the same direction, which transfers the linear movement to latch-pins of levers 442 disposed in second grooves 412, causing levers 442 to pivot about respective latch-axes. This pivotal movement causes the shoulders of respective levers 442 to engage with the respective channels of corresponding latch-arms 444, further causing the latch-arms 444 to pivot about respective arm-axes. In turn, the latch-arms 444 move respective latch plates 445 toward corresponding sides of the track, thus releasably engaging or coupling the latch assembly to the track.

FIG. 7C illustrates an alternative side-elevation view of the track lighting system shown in FIG. 7B, showing the clamp assembly and the latch assembly releasably attached to the track. In particular, the cam movement in the linear direction along collar axis 222A (toward track 130) moves first engagement member 326 toward the track by distance d. This cam movement mechanically, magnetically, and/or electromechanically couples the clamp assembly to track 130. For example, first engagement member 326 may physically interface with a top surface of track 130 and/or first engagement member 326 may magnetically/electromagnetically couple with sub-track plate 230. In addition, electrical contacts (e.g., fasteners 532*f*) electrically engage with corresponding electrical wires 232 disposed in side channels of track 130.

FIG. 8 illustrates a cross-sectional view of the track lighting system shown in FIG. 2, viewed at cut-lines 8-8 and showing track lighting system 100 releasably attached or coupled to track 130.

As illustrated, first engagement member 326 and latch plate 445 (e.g., a second engagement member) releasably engage with track 130. For example, first engagement member 326 engages with portions of track 130—e.g., first engagement member 326 moves into physical contact or otherwise interfaces with a top surface of track 130, and/or first engagement member 326 moves toward track 130 (e.g., by a distance d) to magnetically/electromagnetically couple with sub-track plate 230. Similarly, components of the latch assembly releasably engage with track 130—e.g., latch plate 445 moves toward the side flanges of track 130 to create a physical interface, and/or latch plate 445 moves the electrical contacts of electrical connector 332 into electrical contact with electrical wires 232.

As mentioned above, the electrical contacts—here, fasteners 532*f*—are positioned at relative offsets to engage a specific pair of electrical wires 232. For example, as shown, fasteners 532*f* engage with a top electrical wire on one side and a bottom electrical wire on the other side, which form the specific pair of electrical wires. In one embodiment, the top electrical wires may include a power supply line (e.g., 12V, 24V, etc.) while the bottom electrical wires may be independently associated with respective control lines which transfer control signals (e.g., digital signals, Power Line Communication (PLC) signals, Pulse Width Modulation (PWM) signals, and so on) to electrically connected fasteners 532*f*. The control signals operably control light emitting element 212 (e.g., an LED), e.g., turning the lighting element on, off, and/or performing dimming operations. In particular, as is appreciate by those skilled in the art, lighting assembly 110 and/or clamp assembly 120 can include appropriate control modules/components such as processors, electrical circuitry, Integrated Chips (ICs), and the like. These control modules/components are electrically coupled to electrical wires 232, including the power supply line (top electrical wire) and one of the control lines (one of the bottom electrical wires), via fasteners 532*f*. The control modules/components receive the control signals from the appropriate control line and, based on the control signal, turn the light emitting element on, off, and/or perform dimming operations.

In other embodiments, one pair of electrical wires 232 may be associated with a first power source (e.g., a switch, outlet, etc.), and the opposing pair of electrical wires 232 may be associated with a second power source, which may be different from the first power source, and/or controlled by a different circuit/switch. In this fashion, track 130 may be electrically coupled to one or more power sources having independent controls, which provides additional flexibility for selectively controlling multiple light fixtures coupled to the same track. Put differently, multiple light fixtures may be coupled to the same track, but with alternating orientations, which allows some light fixtures to be independently controlled by different circuits, switches, power sources, etc.

In any of the foregoing embodiments, changing the orientation of the clamp assembly 120 relative to track 130 (e.g., flipping the clamp assembly by 180 degrees) electrically connects fasteners 532*f* to different pairs of electrical wires 232 due to the fastener offsets.

In addition, FIG. 8 also illustrates track lighting system 100 releasably attached or coupled to track 130 along perpendicular engagement planes. For example, as discussed above, track 130 defines a first track engagement plane substantially parallel to its top/bottom surfaces and one or more second engagement planes parallel the sides of track 130—e.g., parallel to terminating ends of the side flanges forming the channels for receiving electrical wires 232. The first engagement member 326 engages with track 130 along the first engagement plane while the second engagement members (e.g., components of the latch assembly such as latch plates 445) engage with track 130 along respective second engagement planes. Notably, the first engagement member and the second engagement member(s) releasably engage with respective engagement planes based on one rotational movement of collar 222.

The devices, apparatus, and systems described herein, therefore, provide low-profile track lighting solutions suitable for any environment or space (e.g., residential houses, commercial buildings, etc.). The low-profile track lighting solutions particularly address issues with conventional track-lighting products, which often include bulky and large fixtures. As described above, the low-profile track lighting embodiments of this disclosure provide dual engagement mechanisms for releasably securing a track lighting fixture to a corresponding track.

While there have been shown and described illustrative embodiments of the low-profile track lighting systems, showing specific movements, orientations, and views, it is to be understood that various other adaptations and modifications may be made within the spirit and scope of the embodiments herein. For example, the embodiments have been shown and described herein with a first engagement member being magnetic and a sub-track plate comprising a ferromagnetic material. However, the embodiments in their broader sense are not as limited, and any combination of magnetic/ferromagnetic materials may be used interchangeably for various components. For example, the first engagement member and/or track may be integrally formed with combinations of magnetic or ferromagnetic materials, as is appreciated by those in the art. Moreover, while certain embodiments are shown and described as having certain features or aspects, such features or aspects may be interchangeably included (or excluded) from any of the embodiments disclosed herein. For example, while some embodiments are shown and described as having a single cam-pin, it is appreciated that multiple cam-pins may be used to improve structural integrity, interfacing surfaces, and so on. The foregoing description has been directed to specific embodiments. It will be apparent, however, that other variations and modifications may be made to the described embodiments, with the attainment of some or all of their advantages. Accordingly this description is to be taken only by way of example and not to otherwise limit the scope of the embodiments herein. Therefore, it is the object of the appended claims to cover all such variations and modifications as come within the true spirit and scope of the embodiments herein.

The invention claimed is:

1. A track fixture device, comprising:

a housing; and a clamp assembly coupled to the housing, the clamp assembly releasably coupling to a track, wherein the clamp assembly comprises:

a first engagement mechanism including a first engagement member, the first engagement member is configured to releasably couple to a first side of the track along a first engagement plane based on a rotation of a collar of the clamp assembly; and a second engagement mechanism including a latch assembly, the latch assembly is configured to releasably couple to a second side of the track along a second engagement plane based on the rotation of the collar, the second engagement plane being oriented substantially perpendicular relative to the first engagement plane.

2. The track fixture device of claim 1, wherein the first engagement plane corresponds to a top side of the track and the second engagement plane corresponds to a lateral side of the track.

3. The track fixture device of claim 1, wherein the first engagement mechanism further comprises:

a base to receive at least a portion of the track;

the collar positioned over the base, the collar rotating about a collar axis;

a cam follower disposed within the collar and rotates about the collar axis; and a cam disposed within the cam follower and in communication with the first engagement member.

4. The track fixture device of claim 3, wherein the cam includes a groove for receiving a cam-pin, wherein the cam follower communicates rotational movement about the collar axis to the cam by the cam-pin, wherein the groove translates the rotational movement into a linear movement along the collar axis as the cam-pin slides along the groove, and wherein the linear movement urges the first engagement member towards the first side of the track.

5. The track fixture device of claim 4, wherein the groove is a first groove and the cam includes a second groove, wherein the second engagement mechanism of the claim assembly further comprises:

a latch-pin in communication with the second groove of the cam, wherein a portion of the latch assembly pivots about a latch axis over the second side of the track based on movement of the latch-pin relative to the second groove.

6. The track fixture device of claim 1, further comprising:

a lighting component in communication with the housing, the lighting component includes at least one light emitting element.

7. The track fixture device of claim 1, wherein the first engagement member is magnetized to facilitate engagement with a ferromagnetic portion of the track.

8. The track fixture device of claim 1, wherein the collar is rotatable about a collar axis, wherein the clamp assembly translates a rotational movement of the collar into a linear movement that causes the first engagement mechanism to releasably couple to the first side of the track and the second engagement mechanism to releasably couple to the second side of the track.

9. The track fixture device of claim 1, wherein the latch assembly includes two second engagement members, each having an electrical fastener positioned at an offset that electrically engage with respective electrical portions of the track.

10. A clamp assembly for coupling a fixture to a track, the clamp assembly comprising:

a base to receive at least a portion of a track;

an engagement member disposed within the base;

a collar positioned over a top side of the base, the collar rotating about a collar axis;

a cam follower disposed within the collar, the cam follower rotates about the collar axis; and a cam in communication with an engagement member, the cam including a groove that receives a cam-pin from the cam follower, the groove translating a rotational movement of the cam follower into a linear movement of the cam along the collar axis to releasably couple the engagement member to a first side of the track.

11. The clamp assembly of claim 10, further comprising:

one or more posts that couple the collar to the cam follower, wherein the one or more posts communicate the rotational movement of the collar about the collar axis to the cam follower.

12. The clamp assembly of claim 11, wherein the one or more posts register with one or more corresponding slots defined by a circumferential recessed lip of the collar.

13. The clamp assembly of claim 10, wherein the engagement member interfaces with a portion of the track based on the linear movement of the cam along the collar axis.

14. The clamp assembly of claim 10, wherein the engagement member is a first engagement member and the groove is a first groove, the clamp assembly further comprising:

a latch assembly disposed in the base, the latch assembly including a second engagement member and a latch-pin in communication with a second groove of the cam, and wherein at least a portion of the latch assembly pivots about a latch axis based on movement of the latch-pin relative to the second groove to releasably couple the second engagement member to the track.

15. The clamp assembly of claim 14, wherein the track includes a set of flanges that define a channel for receiving electrical wiring, wherein the latch assembly further comprises:

a lever having a first side that forms the latch-pin and a second side, opposite the first side, that forms a shoulder, wherein the lever pivots about the latch axis based on movement of the latch-pin relative to the second groove of the cam;

a latch-arm in communication with the shoulder; and a latch plate forming a portion of the second engagement member, the latch plate securing a portion of an electrical connector to the latch-arm, wherein the latch-arm pivots about an arm axis when the lever pivots about the latch axis causing the latch plate to releasably engage portions of the set of flanges.

16. The clamp assembly of claim 14, wherein the track includes a set of flanges that define a channel for receiving electrical wiring, and wherein the second engagement member comprises a latch plate dimensioned to releasably engage with portions of the set of flanges.

17. A method comprising:

attaching a housing of a track fixture to a base portion of a clamp assembly, the clamp assembly including a collar rotatable about a collar axis;

receiving at least a portion of a track by the base portion of the clamp assembly;

rotating the collar about a collar axis to rotate a cam follower disposed within the collar about the collar axis;

translating a rotational movement of the cam follower about the collar axis into a linear movement for an engagement member along the collar axis; and releasably coupling the engagement member to the track to secure the track fixture to the track.

18. The method of claim 17, wherein the engagement member is a first engagement member, the method further comprising:

providing a latch assembly disposed in the base portion of the clamp assembly, the latch assembly including a second engagement member;

translating the rotational movement of the cam follower about the collar axis into a pivotal movement of latch assembly to urge a portion of the latch assembly toward a lateral side of the track; and releasably coupling the second engagement member to the track to secure the track fixture to the track.

19. The method of claim 18, further comprising:

providing a cam disposed in an interior of the cam follower, the cam having a first groove and a second groove;

communicating, by a cam-pin disposed in the first groove, the rotational movement of the cam follower about the collar axis to the first engagement member; and communicating, by a latch-pin disposed in the second groove, the rotational movement of the cam follower about the collar axis to the latch assembly.

20. The method of claim 17, wherein rotating the collar about the collar axis further comprises rotating the collar about the collar axis in a first direction, the method further comprising:

rotating the collar about the collar axis in a second direction, opposite the first direction, to releasably decouple the engagement member from the track.

* * * * *